US005613916A

United States Patent [19]

Sommer

[11] Patent Number: 5,613,916

[45] Date of Patent: Mar. 25, 1997

[54] SPORTS EQUIPMENT FOR BALL GAME HAVING AN IMPROVED ATTENUATION OF OSCILLATIONS AND KICK-BACK PULSES AND AN INCREASED STRIKING FORCE AND PROCESS FOR MANUFACTURING IT

[76] Inventor: Roland Sommer, Kronthaler Weg 15-17, D-65824 Schwalbach, Germany

[21] Appl. No.: 516,105

[22] Filed: Aug. 17, 1995

Related U.S. Application Data

[63] Continuation-in-part of Ser. No. 30,332, May 20, 1993, Pat. No. 5,454,562.

[30] Foreign Application Priority Data

Jul. 27, 1991 [DE] Germany ..... 41 24 958.5
Oct. 23, 1991 [DE] Germany ..... 41 34 972.5

[51] Int. Cl.[6] ..... A63B 53/04

[52] U.S. Cl. ..... 473/332; 473/333

[58] Field of Search ..... 273/170, 171, 273/172; 473/332, 333, 334, 335–339

[56] References Cited

U.S. PATENT DOCUMENTS

| | | | |
|---|---|---|---|
| 690,940 | 1/1902 | Febiger | 273/170 |
| 2,067,556 | 1/1937 | Wettlaufer | 273/170 |
| 2,592,013 | 4/1952 | Curley | 273/170 |
| 3,589,731 | 6/1971 | Chancellor | 273/170 |
| 4,541,631 | 9/1985 | Sasse | 273/170 |
| 4,655,458 | 4/1987 | Lewandowski | 273/170 |
| 5,121,922 | 6/1992 | Harsh, Sr. | 273/170 |

*Primary Examiner*—Mark S. Graham
*Attorney, Agent, or Firm*—Helfgott & Karas, P.C.

[57] ABSTRACT

Sports equipment for ball games comprising a stroke portion and a shaft portion including a grip, in particular a tennis racket or a golf club, wherein mass particles are integrated into the equipment structure which are freely displaceable or freely movable thereto and which are provided in one or a plurality of chambers the volume of each of said chambers being small relative to the interior volume of the stroke and/or the shaft portion. The stroke characteristics of the sports equipment can be varied depending from the distribution of the chambers within the structure and/or from the amount of the mass particles used. Stroke shocks are attenuated with the result that occurrence of "tennis elbow" is diminished. Indicated is also a method for the manufacture of a tennis racket having high shock absorption and good oscillation attenuation properties and being manufactured in fiber-plastics-structure techniques.

14 Claims, 12 Drawing Sheets

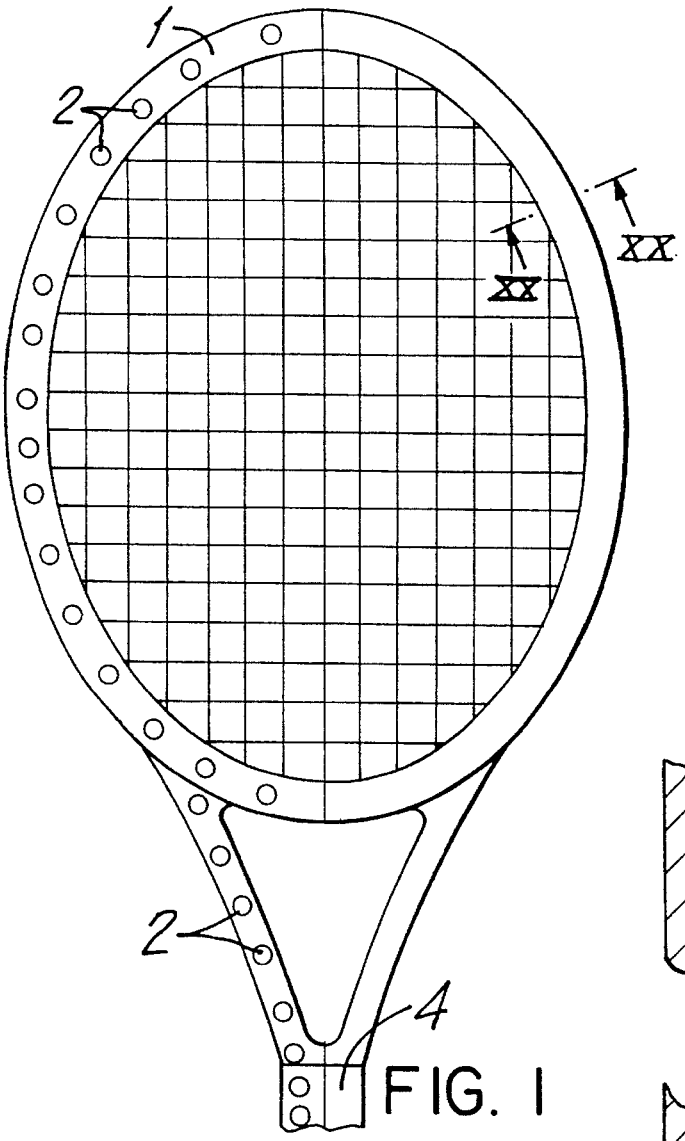
FIG. 1
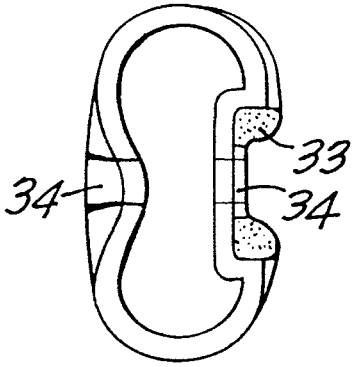
FIG. 20
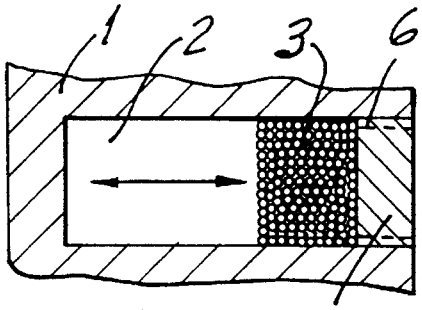
FIG. 3
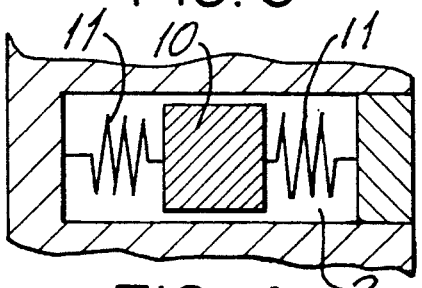
FIG. 4
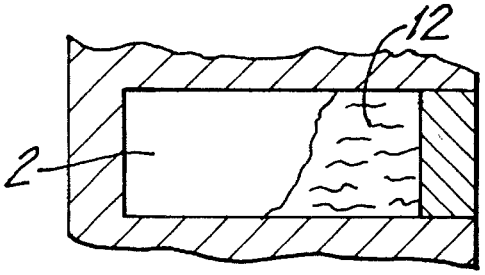
FIG. 5
FIG. 2
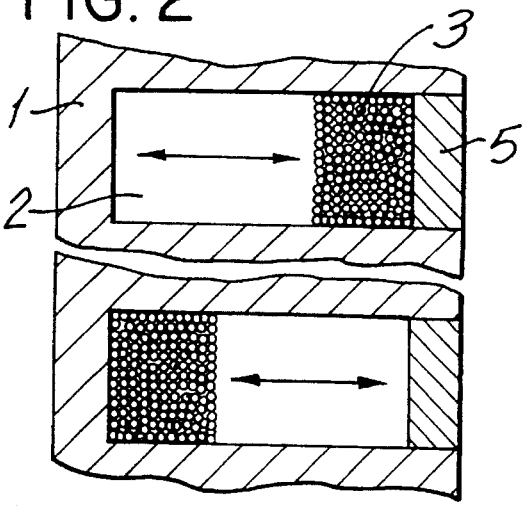

SPORTS EQUIPMENT FOR BALL GAME HAVING AN IMPROVED ATTENUATION OF OSCILLATIONS AND KICK-BACK PULSES AND AN INCREASED STRIKING FORCE AND PROCESS FOR MANUFACTURING IT

This is a C-I-P application to application Ser. No. 08/030,332, filed May 20, 1993, U.S. Pat. No. 5,454,562.

BACKGROUND OF THE INVENTION

The invention relates to sports equipment for ball games comprising a stroke portion and a shaft at the external end of which a handle portion is provided, particularly to tennis rackets and golf clubs. It can however also be used for sports equipment for other ball games where the ball is struck with a high force, as in cricket, polo, baseball etc.

It has been known for a long time that the "tennis elbow" so dreaded by all tennis players and golf players is caused in the first instance by the vibration or after-oscillation of the racket or club during the hitting action. For this reason, manufacturers of tennis rackets all over the world have been searching for constructional possibilities to attenuate these vibrations of the racket. The same is true for other sports equipment by which a ball has to be hit with great force by a player, for instance a golf club (wood 1-3). While the clubs or rackets are differently formed according to the type of sport, they have in common that the player holds the equipment at a handle portion which is normally at the external end of a shaft, and via a more or less extended shaft transfers his high stroke force via the stroke portion of the equipment onto the ball. The kick-back and the oscillation of the equipment fully react on the player's arm. By the kick-back and the natural vibration of the racket, further on, striking energy is lost which could be used for the acceleration of the ball.

Latest developments on the field of sports equipment, particularly tennis rackets and golf clubs, show that the aim of obtaining a real freedom from vibration and a good shock absorption and a good oscillation attenuation has a yet not nearly been reached.

It has already been known that-by integration of a freely movable mass, for instance lea shot or a heavy liquid, into a tennis racket, oscillation attenuation can be obtained. This effect has for instance been used in U.S. Pat. No. 4,812,512 describing a tennis racket of the earlier design in that additional chambers were applied outwardly to the finished racket. By such a supplementary application, however, the racket becomes heavy and tends to nose heaviness. In a further embodiment of the cited U.S. Patent, a subdivision of the hollow interior space of the racket frame is provided in the kind of compartments whereby such a subdivision chambers are produced in the interior space of the frame which are each filled with the freely movable mass particles, for instance lead shot. In this embodiment, the chambers are relatively large as compared to the interior space of the frame. By too large individual masses however, an insufficient oscillation attenuation is obtained since at oscillation the mass particles are to a great extent at an oscillation nodal point or at zero passage so that attenuation is not at its optimum.

There is still a need to further improve the attenuation values of tennis rackets. This is particularly true for the attenuation of the stroke shock. This strain is the most dangerous for the tennis player's wrist.

An important role with the tennis rocket-further on plays the "sweetspot" which corresponds to the area which is defined by the zones in which the attenuation starts to drop relatively steeply from a high value to low values. The positioning of the "sweetspot" on the tennis racket area has been the object of many endeavors and calculations. Since, however, different stroke characteristics also imply different positions of the sweetpoint, a general optimization of the position of the sweetpoint, small in relation to the racket area, was not possible.

With respect to golf clubs, the present inventor has carried out several studies and experimentations which have shown that the simple theory of the stroke between the golf club head and the ball is not accurate. That is, it has been believed that the momentum during the process of the ball and the head contact is constant. The inventor, in fact, has found that a theory of the ball and head contact includes not only one momentum but two momentums of different value.

SUMMARY OF THE INVENTION

It is the object of the invention to produce a sports equipment which has a high shock absorption and good oscillation attenuation properties and thus protects the player's elbow and in addition leads to a substantially increased acceleration of the ball by a better use of the stroke energy. In particular, a tennis racket having these properties and a process for manufacturing it, is described.

This problem is solved in that, in the sports equipment structure, mass particles or areas freely displaceable relative thereto are integrated provided in one or a plurality of chambers whereby each of such chambers is small relative to the interior volume of the stroke portion and/or the shaft and is completely embedded in the interior of the stroke portion and/or the shaft. The freely displaceable mass particles comprise, in the most simple case, a loose fill of individual particles, e.g. granulate, metal shot, power, dusts (metal dusts) or a granular fill. The particles may be ball-shaped or of irregular shape. It may be of advantage if the mass particles have no ball shape since in such a case the loose fill may, under the impact of force, be better compressed than would be the case with ball-shaped particles forming a compact fill.

The mass implanted for absorbing shocks and oscillations may be a material continuously filling the space which, by compression and consolidation, undergoes a mass displacement. To this end, jelly-like materials or elastic foams may be used at room temperature. Silicone foams constitute a particularly preferred material. It should be noted that such jelly or foam shaped materials may include elastic particles embedded therein which upon the impact of force move with and within the carrier medium and hence effect mass displacement.

The latter structure is of advantage in equipment in which the free to and fro movement of bodies within the equipment should or has to be avoided.

The invention relates, in the first instance, to tennis rackets and golf clubs and for the sake of simplicity is described in connection with these two types of sports equipment.

By a freely displaceable or freely movable mass Integrated in the equipment, of the order of magnitude of the mass of the tennis or golf ball accelerated relative to the equipment, kinetic energy stored in this movable mass at the stroke at the collision of the equipment with the ball and thus the retardation of the equipment is released upon the displacement or movement of this mass in the direction of the stroke. By this, the kinetic energy acts additively and in addition to the energy transferred from the racket structure onto the ball is released to the ball. This means that the force acting as a "backstroke pulse" onto the racket is compensated and an additional force in the order of magnitude of the backstroke adds to the acceleration of the ball.

In the preferred embodiment of the tennis racket according to the invention, freely displaceable or freely movable partial masses are evenly distributed around the stroke area in the frame within a plurality of small chambers, for instance in the form of finest load shot of a diameter of from 0.4 to 0.8 mm. The sum total of these partial masses corresponds to the total mass which according to the invention is of the order of magnitude of the mass of the ball to be hit or is determined mathematically or experimentally. This determination will later be referred to in connection with the diagrams in the Figures.

Although the distribution of the partial masses along the circumference is preferably even, an uneven distribution of the partial masses along the circumference may be of advantage. By such an uneven distribution, the weight distribution in the equipment, the so-called swing-weight, may also be changed or influenced. Generally however, the even distribution will show to be best suited since one cannot calculate where on the stroke area of the tennis racket the ball will hit. The even distribution of the partial masses along the circumference provides for the best transfer of force from the frame to the middle. At the stroke directed against the ball, the partial masses are accelerated and, each for its own, store kinetic energy, which when hitting the ball with the racket and the retardation of the racket frame structure connected therewith based on the inertia of the partial masses, is again released as "translatory inertia" when they are hitting the opposite chamber wall.

Considering the timely sequence of a ball stroke with an equipment according to the invention, the first phase of the collision between ball and equipment proceeds conventionally. At the beginning of the retardation of the ball by elastic deformation of the mass of the racket, the freely movable mass which may be subdivided in partial masses disengages because of the inertia from the chamber wall in the back relative to the direction of the stroke to a forward movement so that at the movement reversal of the ball and its separation from the racket, the racket receives a pulse in the direction of the ball. On one hand, the ball is more strongly pushed into its new direction and on the other hand, the kickback of the racket is absorbed.

This effect can, in principle, be observed at any sports equipment according to the invention, be it a tennis racket, golf club or other bat. In the respective equipment, the freely movable mass is adapted to the mass of the ball to be played. This can easily be accomplished since there are rules for the mass of the ball in all known sport disciplines. Which preferred embodiment for the shape of the chamber and the form, distribution and material of the freely movable mass is selected, depends on the characteristics of the type of sport, the equipment used and the way in which the stroke is performed.

As the main effect, at a stroke with an equipment according to the present invention, the accelerated mass or the mass to be accelerated of the tennis or golf ball is compensated and at the some time an almost ideal attenuation of the equipment is obtained so that a distinct oscillation and torsion of the racket frame in case of the tennis racket or the shaft in case of the golf club is impossible from the very beginning.

As material for the freely movable mass introduced according to the invention, all heavy materials are suitable, particularly metals as lead or steel or a heavy liquid. Lead, particularly lead shot, is preferably used since it has the advantage of the highest mass by volume.

In certain kinds of sports equipment it may be desirable that the freely movable mass (or partial masses) release their kinetic energy or inertia delayed. If the type of sport requires that the equipment, shortly before the collision with the ball, is "sensitively" somewhat retarded, the freely movable mass should attenuatedly be used. Such attenuation can be obtained by an elastic support of the freely movable mass in its chamber. To this end, the freely movable mass can be supported by two springs, preferably at the chamber wall backward in the stroke direction and the front chamber wall. An oscillating bar support of the mass is also possible whereby the bar has its base at a chamber wall which relative to the stroke direction can be designated as a side wall.

While as has already been mentioned the freely movable mass is preferably distributed evenly on the circumference of a tennis racket, it may also be distributed along the circumference in accordance with a distribution function in order to equalize stroke or rocket characteristics. This deviation from the linearity of the distribution may also consist in that while equal masses are distributed along the periphery, the hollow spaces wherein they are provided are differently deep relative to the stroke direction, are inclined relative to the stroke direction to be expected or are differently shaped. In case of an equipment having a long shaft, such as a golf club, cricket bat, polo stick, etc. this will be of less significance. In case of a tennis racket, however, different retardations up to the inset of the effect of the inertia mass at different places on the periphery can be obtained.

The chambers in which the masses are provided need not be solidly sealed, they may be closed by a stopper which is removable. By using screws or by forming the stopper as a screw seal, it Is possible to open the chamber and to vary the freely movable inertia mass contained therein. This offers the player the possibility to optimally adopt the equipment to his way of playing.

In the case of a tennis racket, a chamber sealable by a stopper and provided at the end of the handle may retain additional masses which additionally serve for taring the tennis racket relative to its center of gravity.

The provision of chambers containing freely displaceable or freely movable masses in the frame and the shaft of modern tennis rackets poses problems. These mass-filled chambers have to be so incorporated in the frame of the tennis racket that the process of automated manufacture of the tennis rackets is not essentially impaired.

For the manufacture of a special rocket frame, a fiber-inforced laminate foil is produced and is rolled to a hose-shaped roll; this hose-shaped roll is inserted into the open mold for a tennis racket and the mold is closed. Subsequently, at increased temperature and by increasing the interior pressure, the hose is pressed to the inner wall of the mold, is cured, and the Interior space of the hose is stiffened by blowing in a setting (curing) foam.

The structure of this tennis racket manufactured in accordance with the present state of plastic fiber technology essentially consists of a tubular or hose-shaped arrangement of differently oriented compound fibers such as graphite, aramite, boron fibers or glass which are laminated by means of an artificial resin, preferably epoxy resin onto a carrier foil and subsequently are rolled, together with the carrier foil, to form a hose-shaped roll. Subsequently, this hose is inserted into the open mold of a tennis racket and the mold is closed. In order to press the hose wall form-lockingly and without any air inclusions or cavities to the inner wall of the mold, the inserted hose is pumped up by high pressure by means of a medium under pressure, for instance compressed air, and in this state is cured at high temperature. After this process, the racket frame as such is finished and could be taken from the mold. Since however the hollow frame, the cross section of which generally is oval, constitutes a tube, it also has the mechanical properties of a tube, i.e. it can dent or bent. In order to counteract this property, the still-hollow frame is completely foamed out by injecting a pressure resistant polyurethane foam. By so doing, the buckling resistance in the first place is enormously increased and a mechanically highly strainable tubular frame is obtained which can be taken from the mold as a finished tennis racket.

To provide the mesh of the tennis racket frame, holes are provided in the tubular frame. For this purpose, a groove is commonly provided on the wide side of the frame oval into which the tensioning string is so inserted that it does not project beyond the frame contour after the mesh was provided on the frame.

This fundamental description of a modern tennis racket manufacturing process in fiber compound technology shows that the compartmental technique revealed in U. S. Pat. No. 4,182,512 cannot be applied in the practice of modern tennis racket manufacture. The compartmental chambers prevent the passage of a fluid through the hollow racket frame and the intrusion of polyurethane foaming material. The chambers including the mass particles, further on, cannot be so positioned in the interior of the tubular frame that in the subsequent bore process a puncturing of the mass chambers will be avoided.

When inserting the chambers filled with the movable masses, it should of course be avoided, similar as in the case of the tennis racket frame manufactured as described above, to puncture the chambers containing the mass particles when applying the mesh. The present invention provides for an adaptation to the above described modern manufacturing techniques.

The provision of oscillation-attenuating or freely displaceable masses within the framework of a tennis racket is made possible as in accordance with the invention without interfering with the predetermined complex and optimized manufacturing process or making it unduly expensive. To this end, the invention provides for a tennis racket having an improved attenuation of oscillations and kick-back pulses, improved shock absorption and stroke force increase and at the same time provides a process for its manufacture with due consideration of an automated manufacturing technology for tennis rackets.

In accordance with the principle of the invention as described, both commercially available tennis rackets as well as commercially available golf clubs were reconstructed and tested. Players who owned these rackets, or clubs, and hence were familiar with them related that prior to the reconstruction, the rackets, or clubs, respectively, showed a distinctly sensible oscillation behavior and an intense effect onto hand and arm. The tennis rackets and golf clubs reconstructed in accordance with the invention were subsequently tested in practical play both by amateurs as by professional players.

As a result of these tests with the reconstructed tennis rackets, the following substantial properties, or differences, respectively, could be noted:

1. The tendency to oscillation of a reconstructed racket has completely disappeared.
2. The "kick-back pulse" acting on the player's wrist is reduced to a minimum, particularly in case of backhand strokes. The racket makes a very comfortable and non-tiring play possible.
3. When striking with the edge areas of the racket, the reacting torsional force acting on the wrist is also reduced to a minimum. The directional exactness of the stroke is increased by a multiple.
4. With the reconstructed racket, a generally substantially increased directional stability could be stated as compared to a normal racket.
5. In case of serve and volley, a substantially increased ball velocity was obtained with the same or even reduced energy consumption.
6. A player having a distinct "tennis elbow" was able to play, with the reconstructed racket, through a complete match without the minutest sign of the characteristic pains. When using the non-reconstructed racket, the pains appeared after a few strokes. According to the statement by the testing player, it took great efforts after the test to resume a normal play with a normal racket.

The advantages of the tennis racket according to the invention are obvious. Both theoretical calculations and practical tests have shown that the attenuation of a tennis racket as an oscillating system is obtained by means of freely movable masses which serve as a storage of kinetic energy. With a view to the attenuation of the oscillations and the kick-back pulses, the danger of the formation of a "tennis elbow", from a medical point of view, is substantially reduced. The invention makes it possible to provide tennis rackets manufactured in accordance with the latest plastic fiber technology with adaptable chambers for the attenuation of oscillations and kick-back pulses and to introduce such tennis rackets on the market at economically acceptable additional costs.

It is also essential that by the manufacturing process according to the invention not only an even oscillation attenuation around the rocket frame periphery but also a widely variable distribution of the oscillation attenuation can be obtained. The oscillation-attenuation masses can be arranged in a finely distributed form along the whole stroke portion or at the desired places.

As will later be described in detail, measurements on a tennis racket equipped as in accordance with the invention have shown that the attenuation in rackets according to the invention is very high over a large area of the racket surface so that the optimum stroke point referred to in common tennis rackets as the sweetspot, includes a large surface area in tennis rackets according to the invention which turns almost the whole rocket surface, except for the edge area, into an extremely well attenuated sweetspot-like stroke area. The variation of the positioning of the sweetspot on which hitherto much effort was spent, does not play any role anymore. Almost the whole useable racket surface of the tennis racket according to the invention shows sweetspot characteristics.

In the manufacture of a tennis racket according to the invention, it becomes possible, by the special shape of the carrier belt including the chambers along the edges with the middle portion left free, to obtain a positioning of the mass chambers while there is no danger of puncturing the chambers after the manufacture of the racket frame when boring the hole for the strings.

The way, the shape and the manufacture of the carrier belt can easily be varied in order to adapt the carrier belt to the requirements. In this connection, the amounts of the attenuation masses may be varied in relation to the desired effect of the oscillation attenuation, and also the swingweight characteristics of the racket can be adjusted or corrected.

The most important condition for the carrier belt is that it is so shaped that 1. an insertion or rolling-in of the carrier belt into the hose of the arrangement is possible;
2. the carrier belt does not interfere with the insertion of the arrangement of the hose into the mold and the positioning of the carrier belt during insertion is safeguarded;
3. the pumping-up for instance with compressed air, and the subsequent foaming up is not obstructed by the inserted carrier belt;
4. the position of the individual mass chambers is so exactly placed that no chamber will be affected by the later provision of the holes for the application of the string mesh;
5. the carrier belt does not cause any weakening of the structure of the fiber arrangement or of the mechanical strength of the racket frame; and
6. the carrier sustains the temperature of about 160 degrees Centigrade generated in the manufacturing process in general.

In the process according to the invention, a carrier belt having chambers is used, which is shaped as a continuous belt having chambers spaced from each other and arranged symmetrical relative to the belt middle longitudinal axis, from which the required length is cut for each tennis racket or the carrier belt is provided in prefabricated belt pieces of predetermined length whereby the chambers are arranged in two rows in predetermined distances relative to each other and with a predetermined distribution so that the properties desired in the finished tennis rocket will be obtained. In any case, the following should be noted for the carrier structure:

In a band of preferably thin stiff plastic foil having a temperature stability in the required range of tennis racket manufacture, two opposing rows of small round, oval or lengthy recesses of desired size are deep drawn in a deep drawing device. Immediately after deep drawing, these recesses can be filled with finest metal or plastic granulate, a heavy liquid or other suited fine dispersed heavy masses. Subsequently, the recesses are closed by welding or glueing a second cover foil over it. There are already fully automated machines on the market as are for instance used for foil packages dispensing tablets.

A belt-like band having deep drawn mass filled chambers has in this way been obtained wherein the individual chambers are arranged along the band edges and in the middle of the band are spaced from each other far enough in order to be able to bore holes between the chambers for the application of the strings without puncturing one of the chambers.

The total width of the band is adapted to the structural height, or to the clear width of the racket frame, i.e. the height of its oval in the direction of the stroke. The number of the individual chambers is adopted to the amount of the mass desired in each individual case and its distribution around the racket frame.

When manufacturing the racket frame, an elongated or correspondingly produced piece of the carrier belt can also be rolled into the hose of the arrangement or may later on inserted into it.

Since the hose of the arrangement is soft and flexible, the alignment of the belt can be directed by touching and, exactly positioned, inserted into the mold. When closing the mold, the belt will in view of the high-oval shape of the racket frame automatically align into an exact position parallel to the axis of stroke. The further manufacturing process can be continued, as described in the beginning, without any interference or change up to a standard procedure.

As material for the carrier belt, materials are suited the melting point of which is at least 50 degrees Centigrade, which constitutes the lower limit for air-curing resins. The selection of the material is hardly limited as long as the material allows molding and sustains the higher temperatures applied in the manufacture of the racket frame. Molding can be performed by deep-drawing, printing, pressing, casting, foaming or mechanical deformation, depending on what is favorable for the material. The manufacture on automated machines as endless bonds or as determined pieces of lengths should preferably be possible. As examples for materials, the following can be mentioned: metals, for instance aluminum; plastic materials, namely thermoplastics and thermosetting plastics, for instance fiber-reinforced polyester or epoxy resins. It is preferred to use materials which are temperature-resistent up to more than 160° C.

The carrier belt including spaced chambers having freely movable mass particles may also be appropriately mounted in the head of a golf club such as a driver for achieving similar results.

In order to further explain the invention, preferred embodiments and examples will be described based on the attached Figures. The examples refer to tennis rackets and golf clubs although they are applicable to other sports equipment as well.

BRIEF DESCRIPTION OF THE DRAWINGS

FIG. 1 is a tennis racket frame showing a portion of the shaft from the top where the chambers including freely movable masses are provided in the frame, and in the shaft;

FIG. 2 is a cross section through a tennis racket frame at a location of a chamber at different times during a stroke (partial cross section views);

FIG. 3 is a cross section through a chamber in which freely movable mass particles in the form of lead shot are provided;

FIG. 4 Is a cross section through a chamber in which a movable mass in the form of a cylinder is provided which is supported within the chamber via two springs;

FIG. 5 is a cross section through a chamber in which a heavy liquid is provided as the movable mass;

FIG. 20 shows a cross sectional view of a racket frame as shown in FIG. 1 illustrating a further embodiment of the invention;

DETAILED DESCRIPTION OF THE PREFERRED EMBODIMENTS

Figure 6:
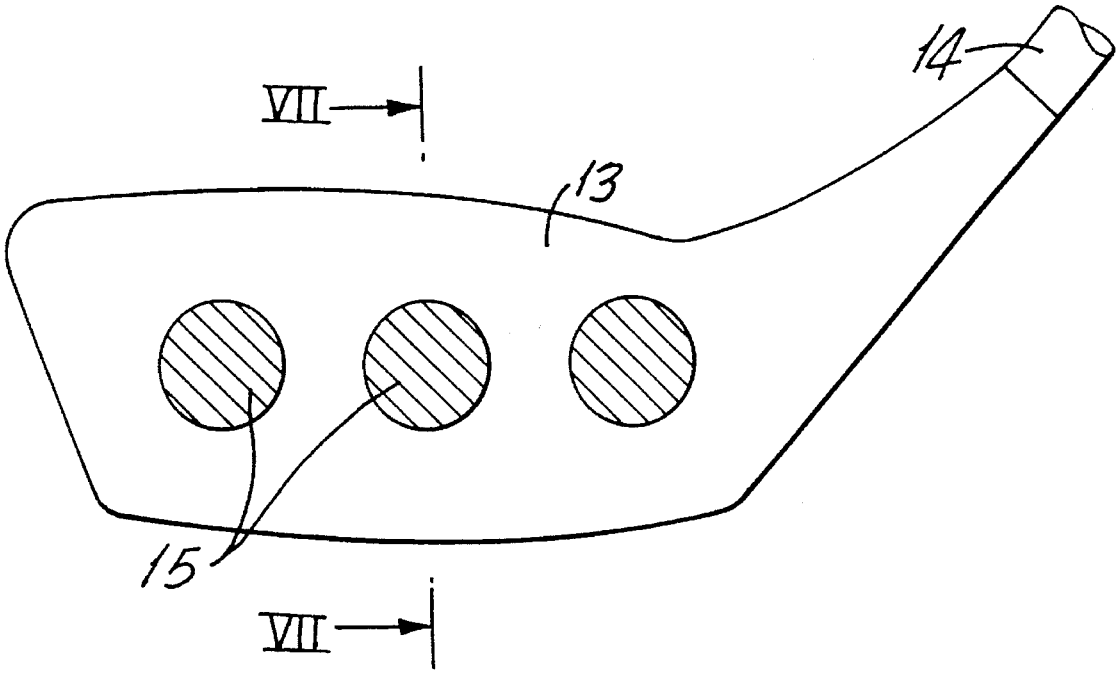
FIG. 6 is a cross section through the stroke portion of a golf club in the longitudinal direction of the club.

FIG. 1 shows the chucking frame of a tennis racket 1, in which chambers 2 are provided distributed along the periphery of the frame and extending to shaft 4, in the hollow space of which movable particle masses, for instance in the form of load shot 3 are inserted. The number of chambers is not limited, but there should be provided so many chambers that the volume of an individual chamber is small in relation to the volume of the stroke portion or the shaft, respectively. As an example, 50 to 150 chambers can be distributed along the racket frame. Only part of shaft 4 is visible. FIG. 2 shows one of these chambers 2 in an enlarged representation whereby two phases during a stroke are shown.

Assuming that the stroke with the tennis racket is so performed that the chamber wall at right in FIG. 2 forms the backward chamber wall, the upper cross section illustrates the position at lead shot 3 shortly before the contact of the racket with the tennis ball. By the swing, the lead shot is pressed against the backward chamber wall.

When the ball touches the racket, frame 1 is decelerated while rocket and ball approximately follow the laws of elastic collision. The freely movable lead shot 3 proceeds to move, based on its inertia, further in the direction of the stroke and hits against the chamber wall which at this stroke is the front chamber wall. This situation is shown in the lower portion of FIG. 2.

Upon impact, the freely movable mass transfers the kinetic energy, or force, received onto the front chamber wall and thus accelerates the racket in accordance with its innate inertia in addition to the force which in case of common rackets is transferred in the stroke. The kick-back of the tennis racket is moreover almost completely compensated for.

In FIGS. 3, 4 and 5 different embodiments of the freely movable masses, in one chamber or partial chamber, respectively, are shown. FIG. 3 corresponds to the relatively simple embodiment of a cylindric chamber closed by a removable stopper 5. In the simplest case, chamber 2 comprises a cylindrical blind hole into which finest metal granulate having a particle size of 0.4 to 0.8 mm in diameter is filled. The total mass filled into all the chambers is approximately in the order of magnitude of the mass of the ball which is to be hit by the respective sports racket. In its simplest embodiment, the chamber can be closed with the material of the racket. In another embodiment it is closed by a stopper 5 provided with a thread 6 by screwing said stopper to the stop whereby said stopper 5 fits highly accurately into the outer surface of the racket. If this embodiment of the removable stopper is selected, the stopper has to be manufactured very accurately so that it does not change the flow conditions around the racket. Such a chamber may for instance be provided at the end of the handle of a tennis racket, where a stopper is removed if, by changing masss 3, the racket is to be tared relative to the point of gravity.

FIG. 4 shows a movable mass in the form of a mass body 10, for instance a cylinder in a hollow cylinder which is secured by springs 11 to the chamber walls. This provides for a possibility to attenuate the movement of mass body 10. A similar effect can be obtained by securing the movable mass via a spring, for instance to one of the side walls of the chamber. Such a mass body damped by one or more springs can also be in the form of a ball.

FIG. 5 shows a further embodiment of the invention where a heavy liquid 12 is employed as the freely movable mass. Similarly, a chamber could be filled, completely or partly. with a material which when hitting is compressed and relaxed.

Figure 7:
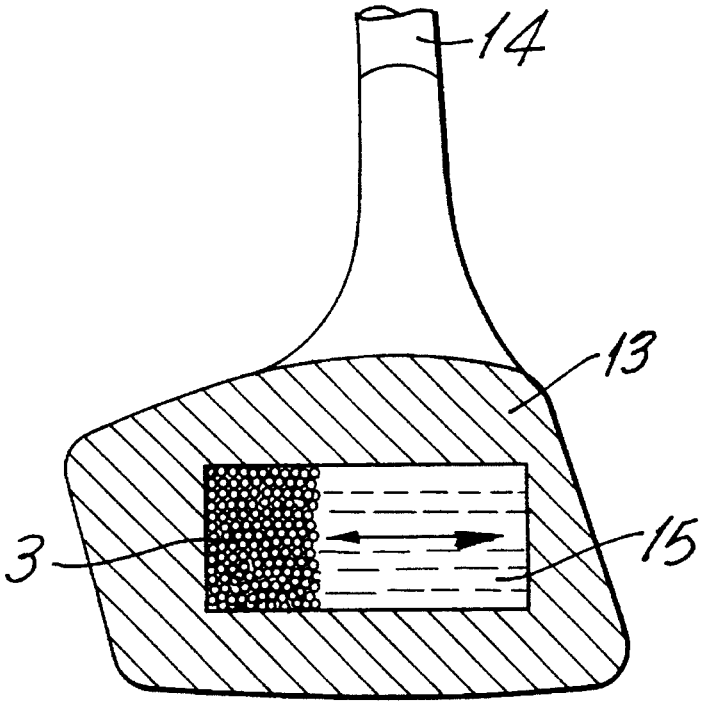
FIG. 7 is a cross section through the stroke section of a golf club essentially perpendicular to the longitudinal direction along line VII—VII of FIG. 6 shortly before the club hits the golf ball.

FIGS. 6 and 7 illustrate the invention based on a golf club. FIG. 6 shows the hitting portion 13 of a golf club, the extension of shaft 14 being only indicated. In the stroke portion of the golf club three chambers are provided arranged one next to the other in the longitudinal direction, i.e. in the curved elongation of the shaft up to the end of the club. The shape of the chambers corresponds to the shape as described in FIGS. 3 through 5 in connection with a tennis racket.

In their simplest form, chambers 15 constitute cylindrical hollow spaces filled with a viscous material, for instance a jelly or a foam, e.g. a silicone foam. In the jelly, free movable mass particles are provided, for instance in the form of shot or other solid bodies. Such movable mass particles may also be embedded in the hollow cavities or in the cell walls of the foam material. The chambers are solidly sealed in the manufacture of the club, or they can be closed by a removable stopper (as in FIG. 3).

Since the stroke area of the golf club is generally determined, it is obvious to provide the chamber opening in the direction averted from the stroke side. As it is possible to open the chamber, the weight of the club and hence the type of club can be varied within certain limits.

FIG. 7 Is a cross section through the stroke section of the golf club of FIG. 6 along the line VII—VII and shows the displacement during the stroke of the movable mass for instance in the form of metal granulate swimming in jelly. The fundamental considerations described in connection with the tennis racket are analogously applicable.

Figure 38:
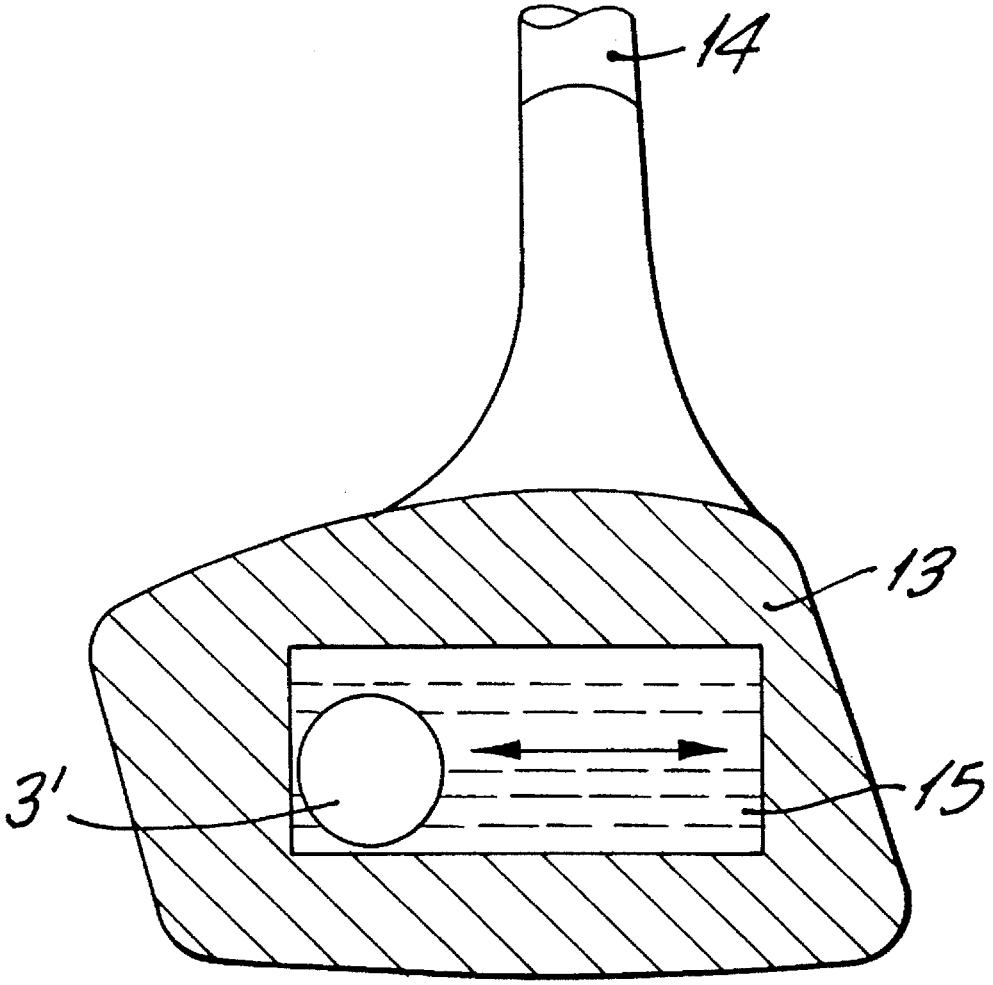
FIG. 38, similar to FIG. 7, is an alternative embodiment of a golf club in accordance with the invention.

FIG. 38 illustrates an alternative embodiment of a golf club in accordance with the invention wherein the metal granulate in jelly is replaced with a ball 3' that is submerged in the viscous medium for example silicone foam or a jelly-like plastic material.

From the explanation of the principle of the invention as based on tennis rackets and golf clubs, it can clearly be taken that the same principle will also apply for equipment for other sports types where on one hand improved hitting conditions are obtained (by the elimination of the kick-back and of oscillations) and on the other hand the stroke force is better utilized to additionally accelerate the hit ball.

Assuming that the process occurring during a stroke can be treated, in the physical sense, as an "elastic collision", i.e. that both bodies, the ball as well as the racket (in case of the tennis racket the string mesh plus the frame) deform elastically, the kick-back force exerted on the wrist was calculated for a tennis racket and for a golf club as a function of the inertia mass. It was assumed that after the stroke, the deformation falls back completely and both bodies are completely separate and retain their original shape. Under inertia mass, the total mass of the freely movable mass particles or of the displaceable mass areas are to be understood.

Figure 8:
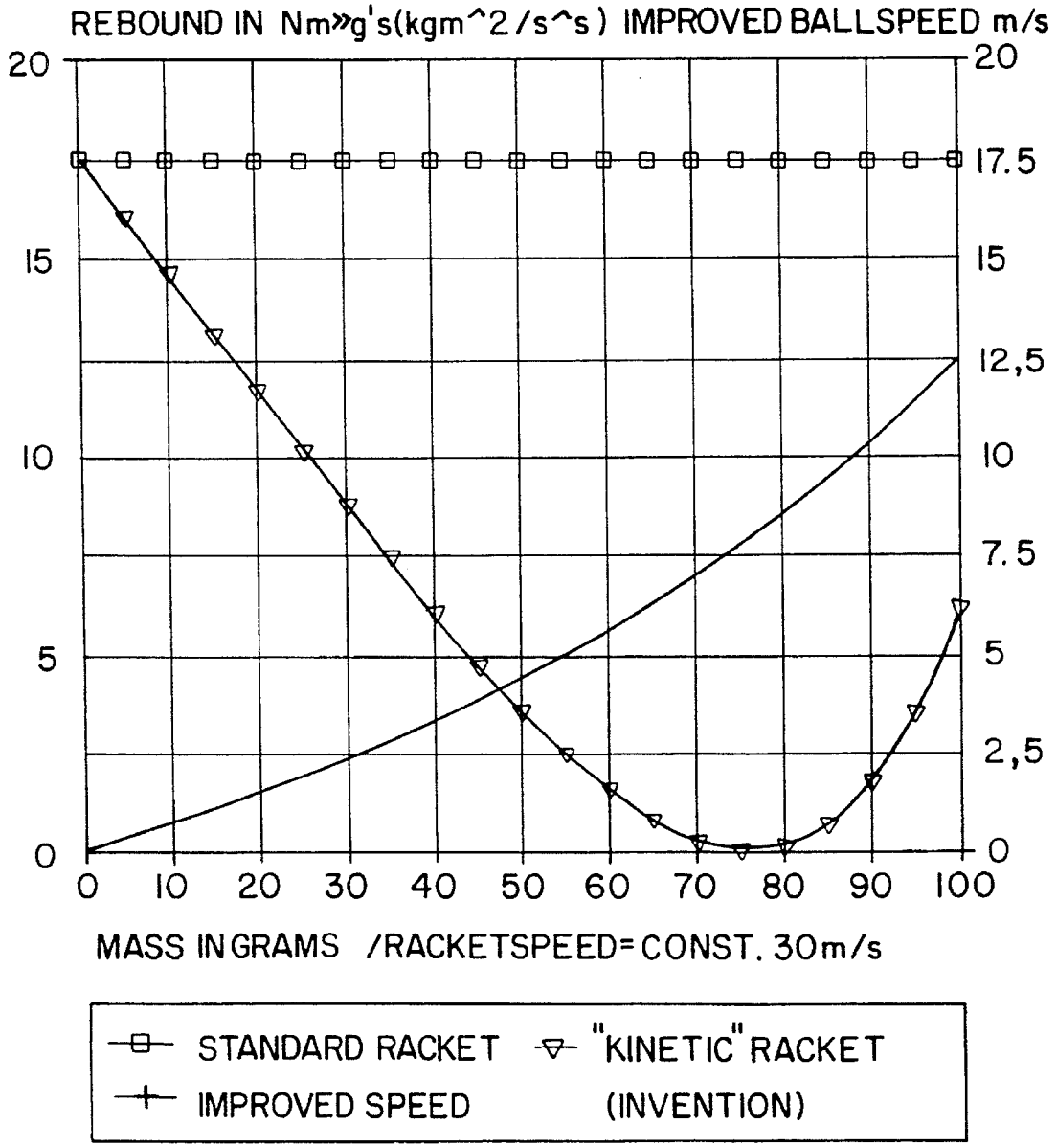
FIG. 8 is a diagram showing a mathematically determined function of the kick-back force In Nm ($kgm^2/s^2$) of the freely movable mass or inertia mass, inserted as in accordance with the invention, in grams at constant racket velocity of 30 m/s for a tennis racket and additionally giving obtainable velocity increase as a function of the inertia mass, the kick-bock force of a common "normal racket" being shown for comparison.
Figure 9:
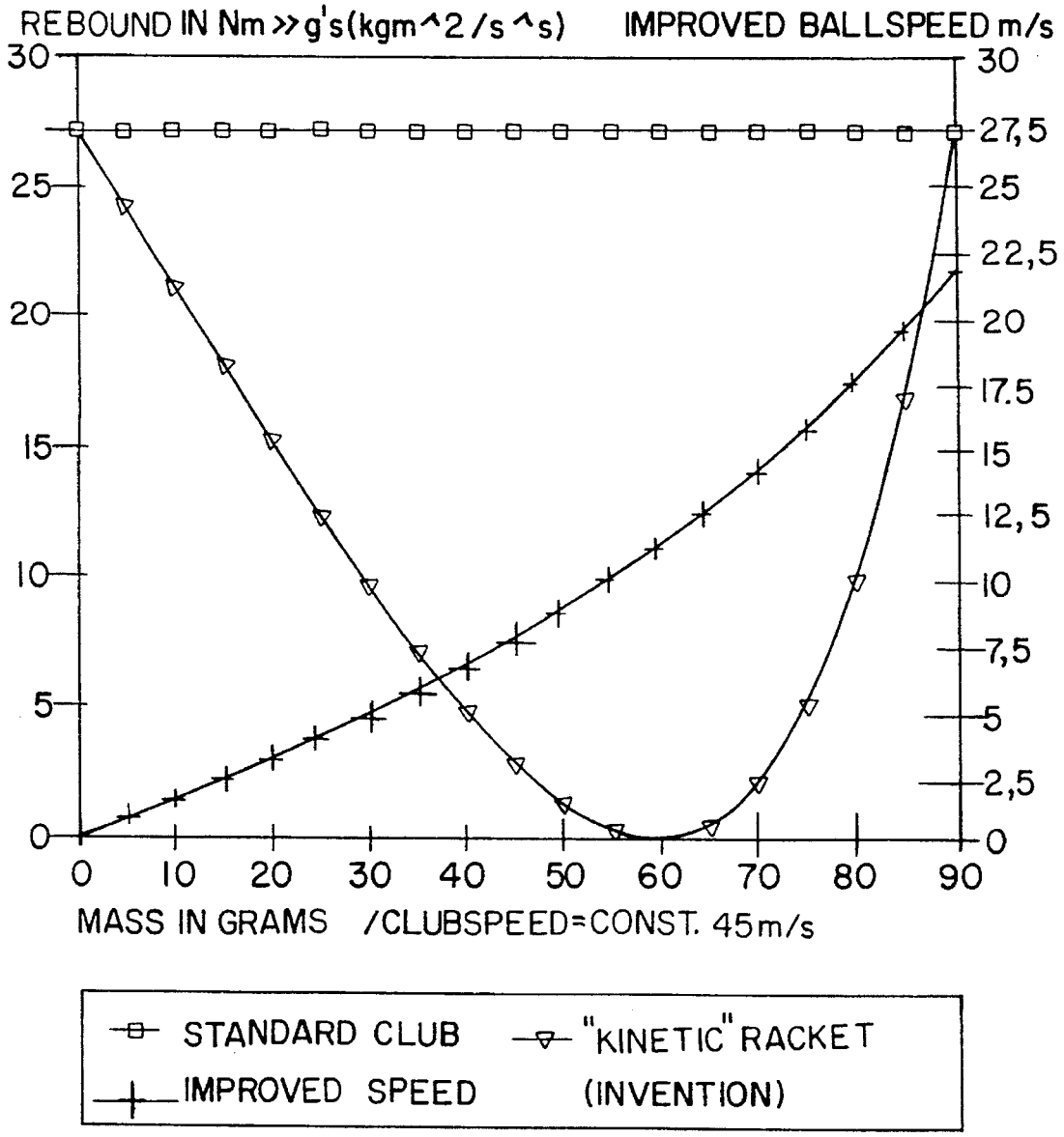
FIG. 9 Is a diagram showing a mathematically determined function of the kick-back force in NM ($kgm^2/s^2$) of the freely movable mass inserted as in accordance with the invention in g at constant club velocity of 45 m/s for a golf club and additionally giving the obtainable velocity increase as a function of the inertia mass, the kick-back force of a common "normal club" being shown for comparison.

On this base, the dependence of the kick-back force on the inertia mass was calculated, which is shown for a tennis racket in FIG. 8 and for a golf club in FIG. 9.

From FIGS. 8 and 9, it can be taken that with the masses of the ball and of the racket given, it can be found of which amount the inertia mass has to be that has to be provided in accordance with the invention.

Finally, the diagrams of FIGS. 8 and 9 also show that with increasing amount of the inertia mass an increasing velocity increase may be obtained in the tennis racket and in the golf club whereby in case of the golf club an increasing distance increase is obtained for the flying distance of the golf ball. In other words, in both cases the striking force applied is used to a better extent.

From FIGS. 8 and 9 it can be taken that a sports equipment, if it is to be designed in advance, at least roughly, for a given velocity, as may for instance be the case in golf clubs, can be influenced in its properties as desired, by determining the inertia mass based on a diagram of the relations shown in FIGS. 8 and 9. Under this point of view, an embodiment is particularly suitable where chambers 2 are accessible via stopper 5 in order to vary the inertia masses.

FIGS. 10 through 15 show preferred embodiments of the freely movable masses (inertia mosses) inserted according to the invention into tennis racket frame and shaft.

Figure 10:
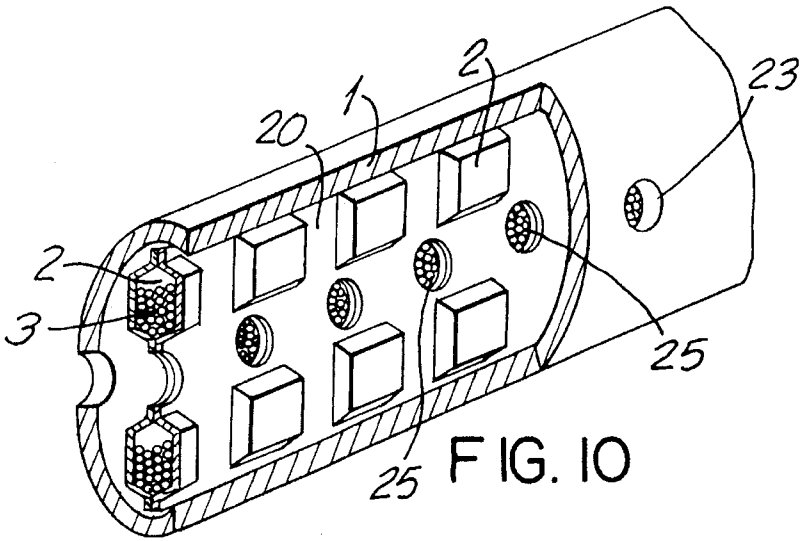
FIG. 10 is a partly cut perspective view of a piece of a tennis racket frame with the carrier belt in it.

FIG. 10 shows a perspective view of a partly cut piece from the frame of stroke portion 1 of a tennis racket in the internal hollow space of which a carrier belt 20 is inserted. In carrier belt 20, chambers 2 are arranged along the two lateral edges, and the chambers are parity filled with mass particles 3. As can be clearly taken from FIG. 11, the frame includes an oval cross section whereby a recess 21 is provided on the flat side of the oval in which a hole 22 for passing the string for the mash is provided. This side is the outer side of the chuck frame of the tennis racket. For providing the strings of the mesh, the string is drawn through hole 23 on the opposing, i.e. inner, side and is then tensioned across the frame.

In order to be able to draw the string through the frame, it is necessary to provide openings in the carrier belt, at about the middle line. Since the middle portion of the carrier belt is free from chambers, the bar between the chambers can be bored without any difficulties so that hole 24 in the middle of the carrier belt is obtained.

Holes 25 shown in FIG. 10 have from the very beginning been provided in the carrier belt to allow for a pressure balance which is particularly necessary in the manufacturing process when compressed air is blown in or the interior space is foamed.

The stroke direction of the tennis racket corresponds to the great height of the oval and hence is in the plane of the carrier belt.

When a stroke is performed with a tennis racket which has a frame as shown in FIG. 10. the mass particles 3, in the beginning, are in the back relative to the direction of the stroke and move foreword in the direction of the stroke when the velocity of the racket decreases. In this way, the kick-back pulse is cushioned and attenuated. On the other side, there is an increase of the stroke force since the mass particles when hitting the front chamber wall import a further forward pulse to the racket.

In the manufacturing process described in detail, where a hose-like roll is rolled from a laminate and the carrier belt is rolled in together with it, the carrier belt is fixed after the insertion into the mold with the band width of the belt correctly dimensioned. A final fixation is obtained after foaming for instance with polyurethane foam.

If the carrier frame is made of a solid plastic or metal tube into which the carrier band is subsequently drawn in, grooves can be provided for fixing the carrier belt to the inner wall of the tubular frame.

Figure 13:
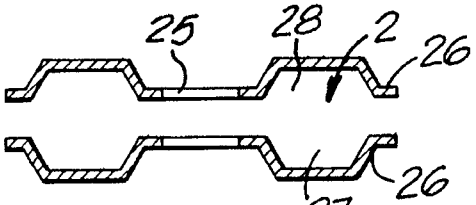
FIG. 13 is a cross section through foils which are composed to constitute the carrier belt.
Figure 14:
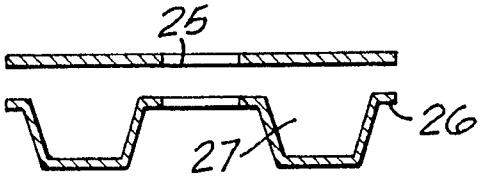
FIG. 14 is a different embodiment of foils prior to the composition as a carrier belt.

In FIGS. 13 and 14, plastic foils are shown from which the carrier belt is composed by glueing or welding. Plastic foils 26 (FIG. 13) preferably consist of thermoplastic foil which is deep-drawable and weldable. Recesses 27 and 28 have been provided in both plastic foils by the known deep drawing molds. After one of the recesses each, for instance 27, has been filled with mass particles 3, for instance metal granulate, the chambers are hermetically closed by glueing or welding on the respective chamber counter piece which includes recess 28.

Holes 25 for pressure balance may be provided in any known way, for instance by punching.

Plastic foil 26 shown in FIG. 14 includes recesses which are filled with mass particles. Chambers 27 are closed with a plain plastic foil which is glued on or welded on.

Figure 12:
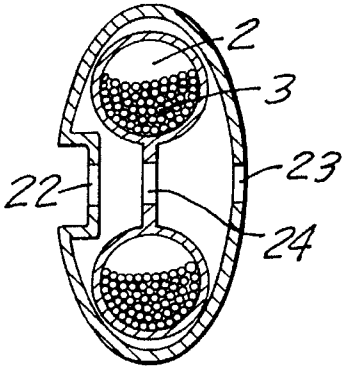
FIG. 12 is a cross section through a racket frame including a different embodiment of the carrier belt.
Figure 15:
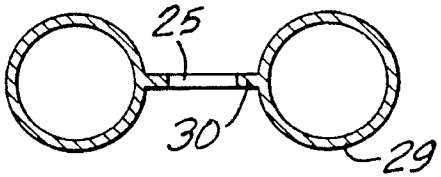
FIG. 15 is a cross section through a carrier belt according to another embodiment.

FIG. 15 shows another embodiment of the carrier belt used in the racket frame shown in FIG. 12. In this case, the carrier belt consists of an extruded plastic double hose 29 including a spacer bar 30. By sectional squeezing of the hollow space of the hose, filling-in mass particles, closing the chamber so obtained again by squeezing etc., a different embodiment of the carrier belt is obtained comprising two rows of chambers each arranged along its edges.

As the materials, also thermosetting plastic foils, if necessary fiber enforced, deep-drawn weldable or glueable aluminum foil, other rolled, pressed, deep-drawn, pressed or blown materials suited for the production of a belt, as well as prefabricated materials, for instance resin impregnated corrugated paper strips or resin paper honeycombs ("Honeycomb") can be used.

The materials employed for the carrier belt have in any case to retain their shape when they are heated, during the manufacturing process of the tennis racket, to the required temperatures, a temperature resistance of 160 degrees Centigrade normally being sufficient.

It is also possible to use two chamber rows, which are applied onto a grid-like but stable temperature-resistant material whereby the distance of the chamber rows relative to each other is safeguarded by solid grid elements. The grid structure has to be sufficiently stable so that, when applying the bores for the holes for the strings, it does not lose its ability to maintain the distance of the chamber rows and to keep the chambers in position and will not collapse when inserting into the mold of the tennis racket frame.

It is further on possible to manufacture the carrier belt as an extruded or pressed portion. In this process, one portion as for instance shown in FIGS. 13 and 14 and referred to by 26 is manufactured as an extruded portion including half chambers, is filled with lead shot in the half chambers and, as described above, is glued or welded together with a second extruded portion or with a foil.

The advantageous properties of the invention will be shown in the following with reference to a tennis racket the frame of which was manufactured in accordance with the compound fiber technology and Into which a carrier belt including mass particles was incorporated as described in connection with FIGS. 10 and 11.

Figure 16:
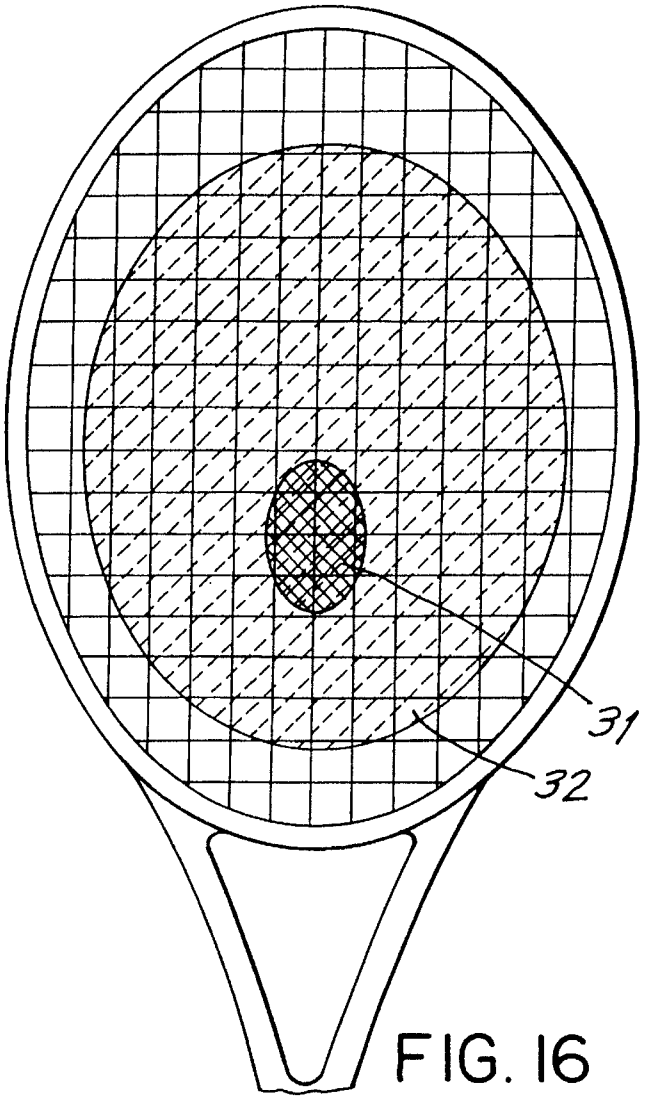
FIG. 16 is a top view of a tennis racket where the sweetspot of a common tennis racket and a sweetspot-like attenuation face of a tennis racket according to the invention is shown.
Figure 18:
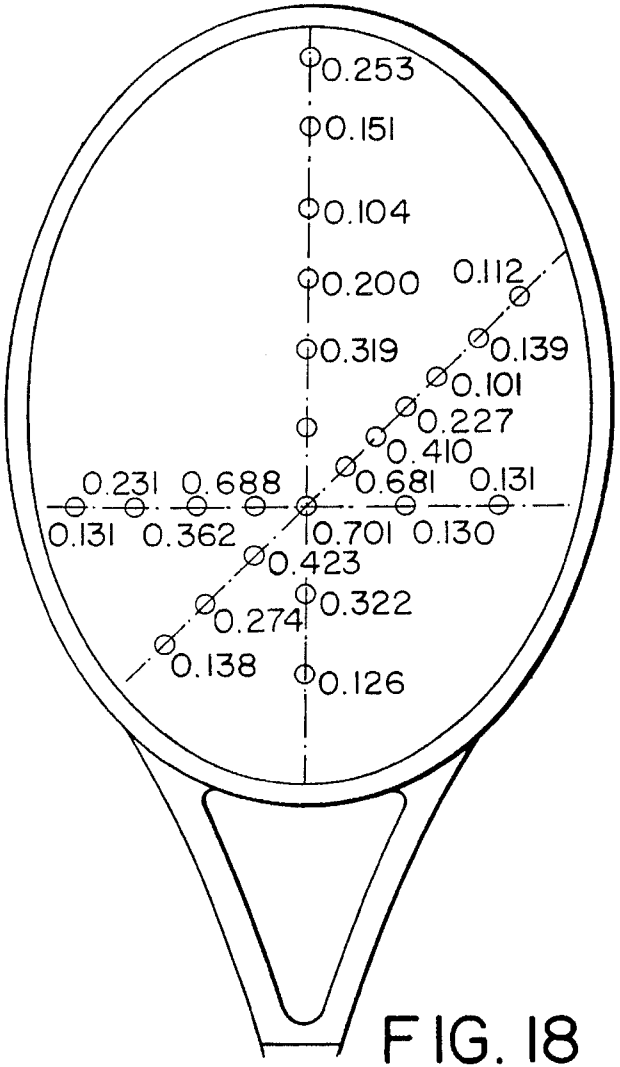
FIG. 18 shows the attenuation measuring values relating to the sweetspot in FIG. 16.
Figure 17:
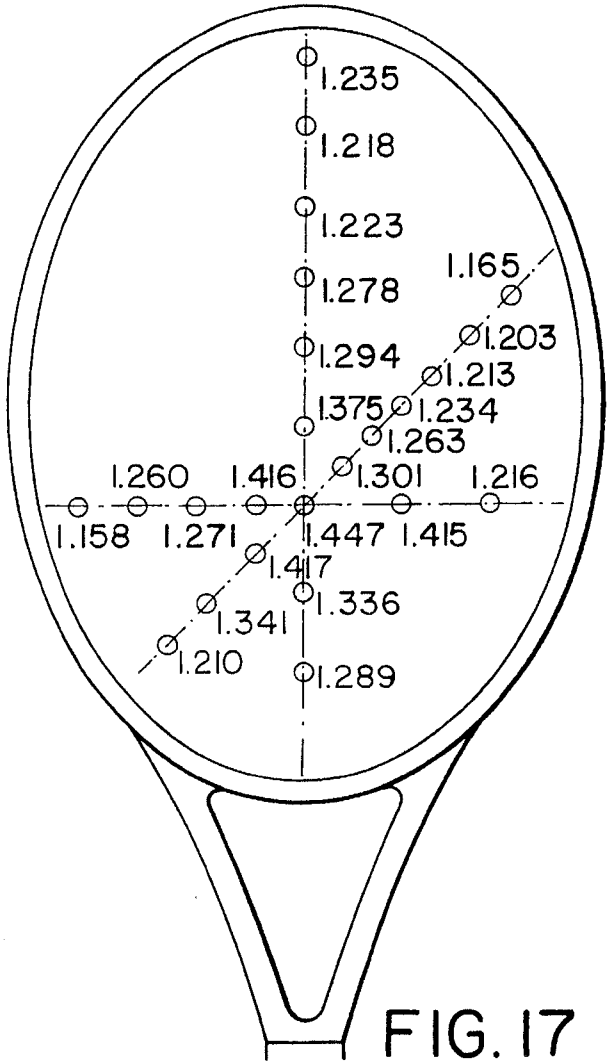
FIG. 17 shows the measuring values of the attenuation relating to the sweetspot-like attenuation face in FIG. 16.

FIG. 16 shows a top view of a tennis racket. Two tennis rackets were manufactured in the some way; one of the rackets included a carrier belt containing mass particles, the other did not, i.e, it was a conventional tennis racket. The attenuation properties of both tennis rackets were measured in that one tennis ball each was dropped with identical velocities onto defined points on the stroke surface. The measuring system permitted the measurement of the respective attenuation of the oscillation after the impact of the tennis ball. The measuring values for the two rackets each are represented in FIGS. 17. and 18, FIG. 17 showing the measurements on a racket according to the invention while FIG. 18 shows the measurement on the conventional racket.

High values correspond to a high attenuation. The measuring values constitute relative units.

On the conventional racket (FIG. 18), the position of the sweetspot could be identified at a certain location of the stroke surface. The line defining the sweetspot at which the attenuation starts to drop steeply from its maximum values, is shown in FIG. 16 and the sweetspot resulting therefrom is referred to by numeral 31.

By means of the same measuring arrangement, the racket according to the invention was measured. The measuring values here obtained are shown in FIG. 17.

It results that an excellent attenuation was measured over the major portion of the stroke surface and only at the edge portion of the racket, attenuation was less. The area that showed a sweetspot-like excellent attenuation in the racket according to the invention is shown in FIG. 16 and referred to by numeral 32.

This shows that efforts to provide the position of the sweetspot of a racket by constructional measures at a particular location, as was hitherto common, are no longer necessary. The attenuation is excellent over the practically usable stroke surface as has hitherto never been reached.

Figure 11:
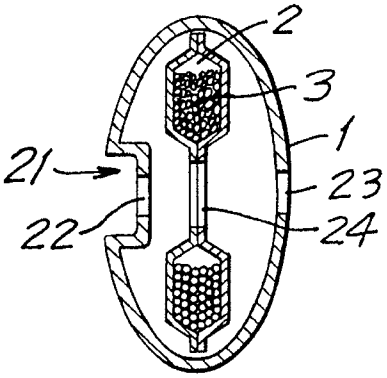
FIG. 11 is a cross section through the racket frame shown in FIG. 10 at a position with chambers.
Figure 19:
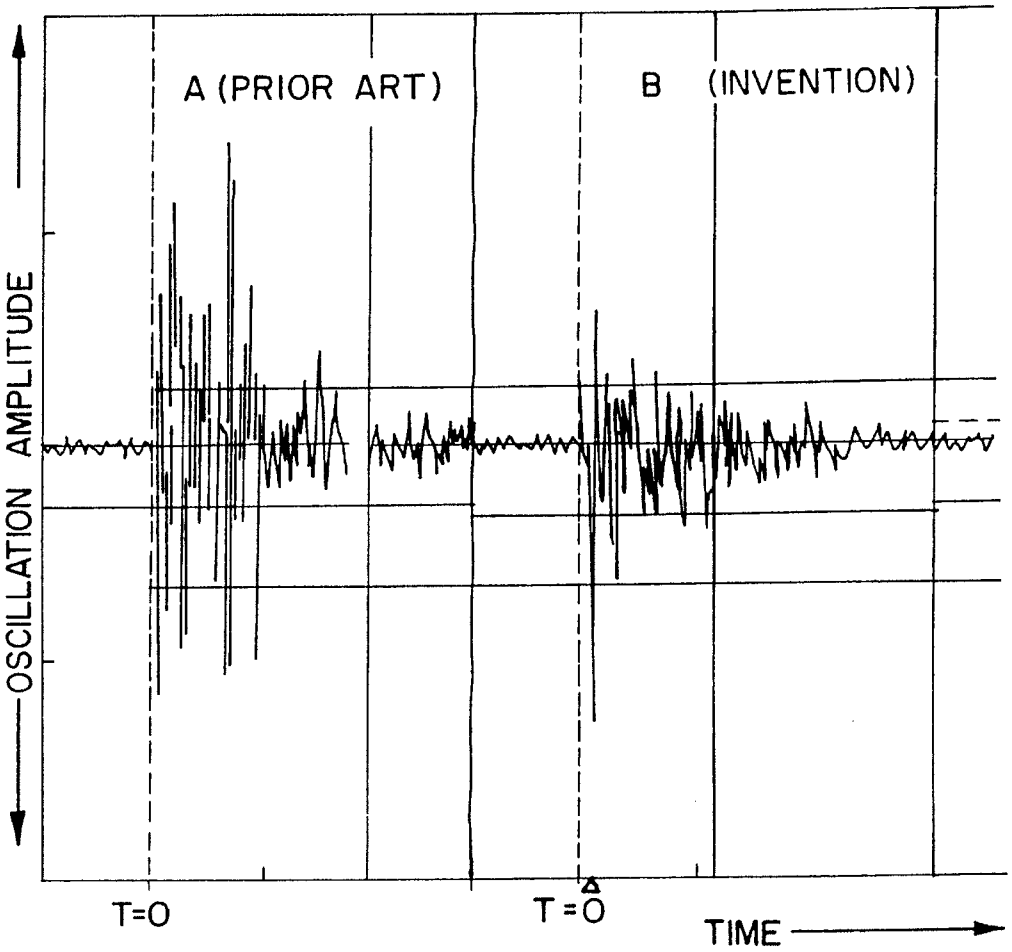
FIG. 19 shows the attenuation measuring values when hitting with a common (curve a) tennis racket and a tennis racket according to the Invention (curve b)

FIG. 19 also shows the result on two identical tennis rackets of which one was a commercial racket (curve a) and the other was reconstructed according to the invention by means of a carrier belt including mass particles as corresponding to FIGS. 10 and 11 (curve b). The total mass integrated in the tennis racket according to the invention amounted to 30 g.

Curves a and b, each, show the attenuation behavior at the tennis racket shaft after the impact of the tennis ball. One can recognize that directly after impact, about the same amplitude appeared on the first oscillation, subsequently however attenuation rapidly set in the tennis racket of the invention so that the oscillation faded away well attenuated. On the prior art racket, compare curve a, attenuation set in later, went up steeply, which is probably due to a resonance point and faded away considerably slower whereby further peaks came up.

It can be guessed that it is not only the absolute values of the attenuation which is of significance for the strain on the player's elbow but their regularity, i.e. that the appearance or non-appearance of attenuation peaks and resonances plays a role.

In a further embodiment of the racket according to the invention a strap-shaped carrier belt having one or two row (s) of chambers filled with free movable mass particles is integrated into the frame wall of the stroke portion and/or the grip portion of the racket. FIG. 20 shows a cross sectional view through the frame of the stroke portion of the racket shown in FIG. 1 for illustrating this embodiment of the invention. A strap-like carrier belt 33 is inserted into the string channel and two rows of chambers-filled with mass particles extend at each of both sides of the holes row for the strings. Such carrier belts can be inserted into the structural assembly during the manufacture of the layered hose made of fiber layers, or can be inserted later into the string channel. In the latter case adhesion methods known per se can be used, e.g. adhesion by means of double-faced adhesive tape.

Now, in the first mentioned case, i.e. inserting the carrier belt into the structural assembly during manufacturing the same, the outer contour of the racket frame will not change at all, since the needed space of the carrier belt will only have effect in the interior of the frame.

In the later integration or attachment of the carrier belt by inserting it in form of a strap into a recess provided therefor at the outside of the racket, however, the advantage is obtained that the carrier belt and the masses effective in connection therewith are variable. In this case the racket can be adapted to the respective requirements of a player by attaching and using carrier belts having varying numbers of chambers and/or varying mass fillings or varying uneven distributions of the chambers and/or the masses around the racket frame.

From FIG. 20 it can be seen that holes 34 for passing the strings can be bored without damaging mass chambers in the carrier belt.

Figure 21:
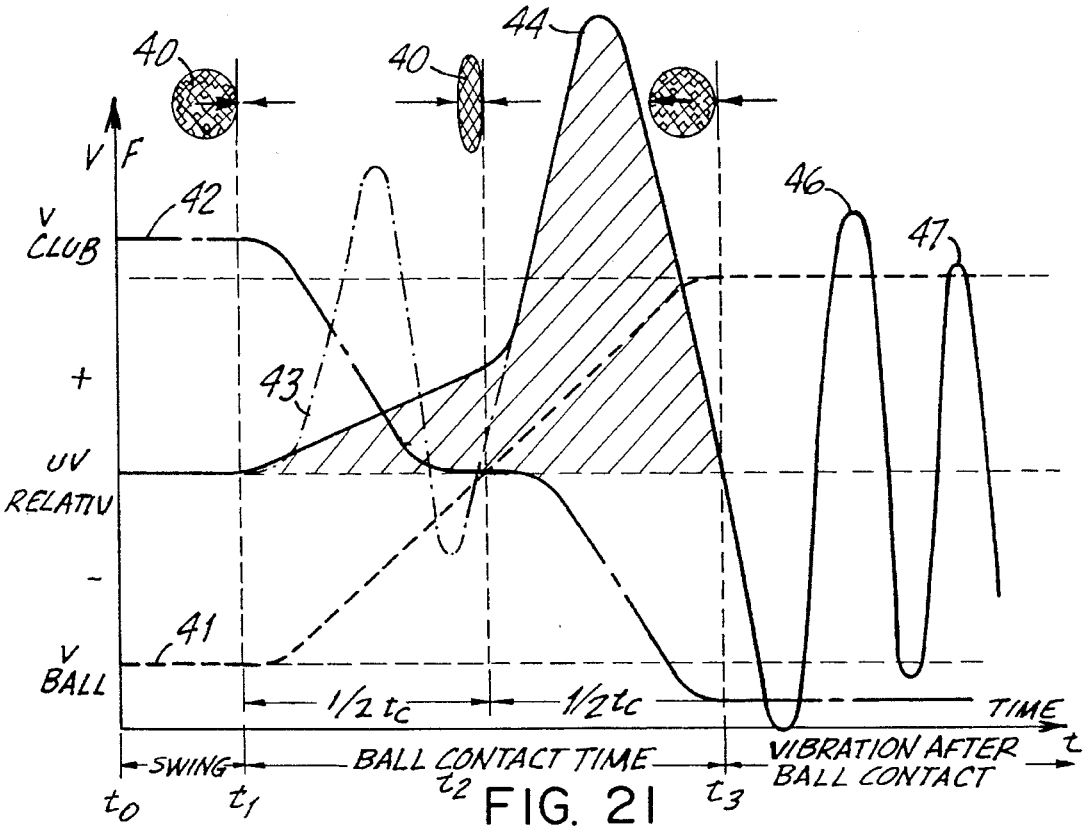
FIG. 21 is a schematic timetable during ball impact illustrating the conditions of a conventional golf club system.
Figure 22:
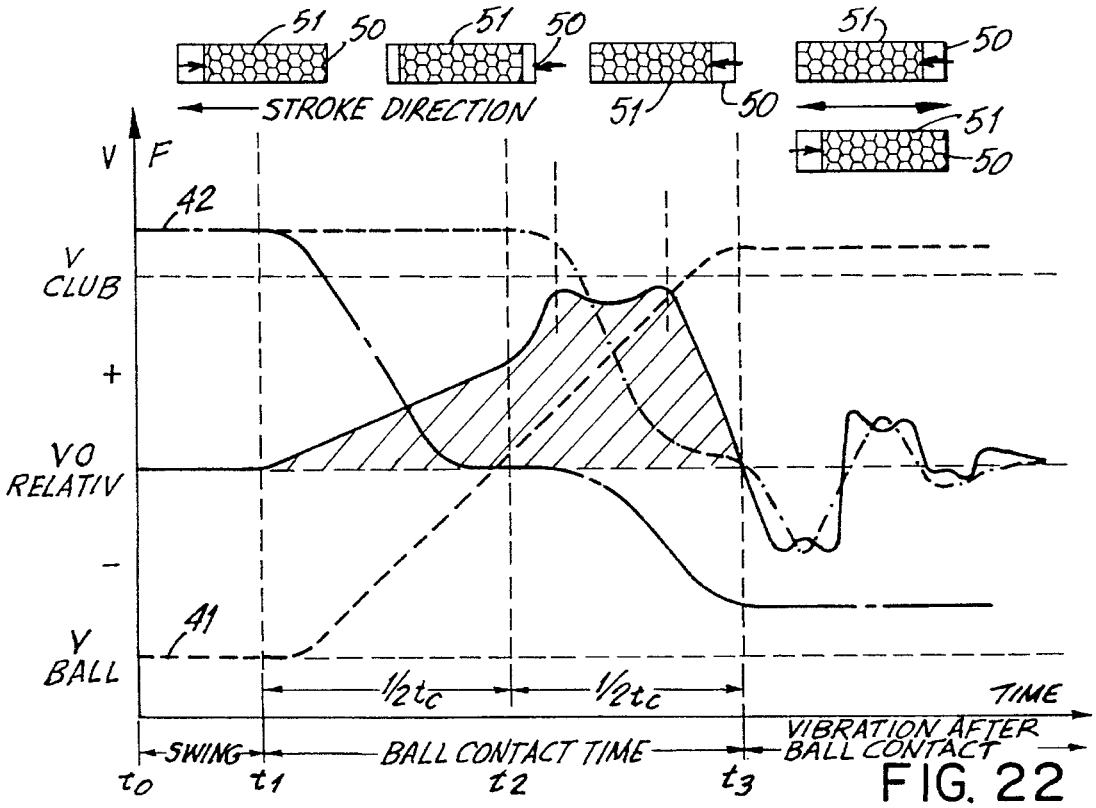
FIG. 22 is a schematic timetable during ball impact illustrating conditions of a system according to a preferred embodiment of the present invention.

Referring now to FIGS. 21 and 22, the application of the principles of the present invention to a golf club such as a driver or other wood will be discussed. As noted above, FIG. 21 is a schematic timetable which shows what happens to the golf ball during the ball impact when an ordinary golf club is utilized.

FIG. 22 is a similar schematic timetable during ball impact illustrating the conditions of a system according to a preferred embodiment of the present invention. In FIG. 21, the velocities of the ball and the club are plotted on the ordinate axis while the time is plotted on the horizontal axis. At time $t_0$, the club and the ball are both aggressed. Between the time $t_0$ and $t_1$, the club is brought backwards and forward so that this is the swing time. At time $t_1$, the ball club makes contact with the ball. At this point the velocity of the ball shown by the line 41 starts to increase while the velocity of the club head shown at line 42 starts to decrease. This is a consequence of the amount of energy which is transferred into the ball from the club. The impact force shown at line 43 starts to rise in proportion to the moment of inertia of the ball and in proportion to its elasticity.

The ball will start to speed up with a constant acceleration reaching the speed of the club precisely at the end of the first half of the contact time. The overall contact time is the time between $t_1$ and $t_3$ whereas one half the contact time is the time between $t_1$ and $t_2$.

The golf ball 40 is shown just before impact at time $t_1$, in its deformed compressed state after impact at time $t_2$ and at its original form after it has expanded at time $t_3$.

In any regular elastic impact system, when two masses such as a golf club and a golf ball impact, a dramatic reaction will result. The stored elastic forces start to reflex, producing further recoil forces which are added to the already existing impact forces. This builds to a frightening recoil shock impulse during a very short time span but with a highly destructive energy density. This is shown at point 44 between times $t_2$ and $t_3$ in FIG. 21.

At the same time, it should be noted that the club velocity line 42 is dropping to the lowest relative speed as a result of the ball's recoil forces. At the time $t_3$, the ball leaves the club face and the entire elastic deformation of the club will cause the resulting vibration which can cause excessive discomfort to the player. The elastic deformation of the club includes the shaft bending and the head deformation and the following vibration maximum amplitudes are shown at points 46 and 47 in FIG. 21. Such club vibration will last a relatively long time period and can only be reduced by the grip or a glove.

The result is quite different by utilizing the kinetic system as shown in FIG. 22. The same graph is shown except that the club head now contains the plastic strip with the movable mass particles as will be explained subsequently. In FIG. 22, the same graph is shown with the same numerals for the velocity of the club, the ball and the shock recoil force. It can be noted that up between the time $t_0$ and the time $t_2$, there is no real difference between the arrangement of FIG. 21 and FIG. 22. Above the time line $t_1$, is shown a chamber 50 containing the mass particles 51. These mass particles have a well defined degree of freedom to move a predetermined distance to synchronize to the very short time period that the ball is in contact with the hitting surface of the golf club.

With the golf ball, this small distance of the mass particles can be as small as 1.23 mm to reach a second time delayed impact after 2.8 mm of ball contact which is the time period between time $t_1$ and $t_3$. This tiny movement of the 15–20 grams of the "kinetic" mass is far too small to alter any of the club head's physical static features during the golf swing. In fact, under most circumstances, this "kinetic" movement is much smaller than the movements of mass caused by the deforming club head during impact.

Such tiny movement is precisely calculated to allow for the "kinetic" mass to have a time delayed second impact starting at time $t_1$ shown as point 1 in FIG. 22 and ending at point 3 between times $t_2$ and $t_3$ right the moment where the dramatic impact shock and expanding recoil forces indicated in FIG. 21 are added to a destructive force impulse. This will clearly be noticeable in the player's hand with the arrangement of FIG. 21 as a strong stabbing pain as well as a long lasting vibration force after the ball has left the club.

In accordance with the principle of the present invention, the traveling kinetic mass precisely timed to this moment of impact and recoil force imparts a time delayed response in the opposite direction to the generated recoil forces. This reduces such forces to a harmless amount which can readily be accepted by the human body.

The channel 50 is shown above the time line $t_2$ wherein the particles 51 have been moved slightly to the left so that they are substantially in the center of the channel. As noted above, at this point there is no change in the swing of the club. At the point 3, the channel 50 is shown with the mass particles 51 moved completely to the left. This provides the second timed impact. Until this point, the "kinetic" system has not had any influence on the static or dynamic features of the golf club.

At this moment, however, the Kinetic mass has reached its precise limited travel distance of about 1.3 mm at point 3 of FIG. 22 and is starting a second time delay impact which ends at point 4 of FIG. 22. This second time delayed impact moves the mass to the front wall of the chamber transferring all the impact forces which are stored in the Kinetic mass in the form of Kinetic energy.

Because the Kinetic mass chambers are securely mounted inside the club, all of the forces are induced directly into the club head, with opposite force direction to the impact forces of the ball. This causes a dramatic limitation to the shock impulse down to an amount which can be deemed harmless to the body of the player. As a direct result of this, the player will get much more feeling as to the quality of the golf stroke without any pain caused by a bad shot. Thus, the most significant action of the Kinetic system utilizing the principles of the present invention to the club is between the points 3 and 4 of FIG. 22 which definitely ends at point 4 with influence to the ball impact forces.

Thus, the system incorporating the principles of the present invention increases the comfort of the player and reduces the risk of injuries. Moreover, it does not have any active influence on the club's power or changes the club's static features, and in fact does not affect the game itself. In other words, the only result is to substantially eliminate the impact recoil which adversely affects the golf player upon hitting the golf ball. The vibration of the club after hitting the golf ball will be absorbed during a bidirectional static action of the Kinetic mass dampening down any vibrations which appear directly at the source. These vibrations will appear at points 6 and 7. After time $t_3$, it can be seen that the mass particles 51 will move from the back wall to the front wall and back again helping in the vibration dampening.

It is clear from the above that this Kinetic system can serve all golfers either low handicap golfers or high handicap golfers who suffer from injuries caused by recoil shock, impact shock or vibration, and the system will protect all players from becoming afflicted by such injuries in the system.

As has been noted above, two different momentums are involved in this arrangement. During the swing of the golf club, a complicated process of impact occurs. In the first contact phase when the head approaches the ball, contacts the same, compresses the same while transferring kinetic energy to the ball, the kinetic energy is converted into potential energy similar to a spring. Thereafter, the ball material expands, the ball is beginning to fly and in the next phase of the impact process, the swing of the golf club accelerates the ball to its intended flight. Thus, in this process the two different momentums have to be taken into consideration during the impact process. Accordingly, the dimensions of the chambers that are inserted in the head of the golf club, the portion which is filled and the remaining void space must be selected such that in the second phase of the impact process, the accelerated masses can contribute to the momentum transfer in such second phase. The result is not only an enhancement of the stroke of the golf club but rather primarily results in the dampening or attenuation of the golf club as reviewed above.

The first impact momentum is a very important criteria for the feeling of the ball where the player receives the feedback from the golf club. It is not the object of the system incorporated in the principles of the present invention to act during this state of impact so that the first condition of timing control is given hereby. However, it is important to reduce the second recoil being the sum of momentum of all the forces in order to decrease the deteriorating effect discussed above. This becomes possible by the timely controlling the second phase of impact in the system incorporating the principles of the present invention. To develop the proper "impact timing", a knowledge of the exact contact period between the ball and the golf club and the speed of the golf club within such period should be provided for. With this data, it is possible to determine the exact difference in speed between the time of the first ball contact and the time of the maximum force/momentum transfer to the ball. The distance that the movable mass particles 51 have to travel in the chamber 50 in order to properly release its stored kinetic energy at the correct time in a second "collision" with the chamber walls can be determined exactly. This will react precisely against the resulting recoil forces. That is, the known contact period only has to be divided by the relative difference speed. On the basis of such considerations, one can select dimensions of each chamber, the proportion of filling, the weight of the movable mass particles, the position, the number of chambers to be included in the golf club head.

The position and dimensions and the number of chambers depend upon various criteria so that it is possible to design and construct a golf club for a learner or for a professional, each being exactly designed for their respective requirements.

The number and the horizontal position within the head of the golf club define the mass distribution and the value of the horizontal area in which the golf club has its best stroke area (sweetspot).

The vertical position has a direct influence on the force introduced into the ball and therefore defines essentially the ball rotation and spin as the most important criteria for its properties of flight. As a general rule, the deeper the force of a stroke or the force of a movable mass system, the need for the center of gravity of the ball, the higher the ball rotation will be which in parts are higher and longer lasting uplifting the ball.

Figure 23:
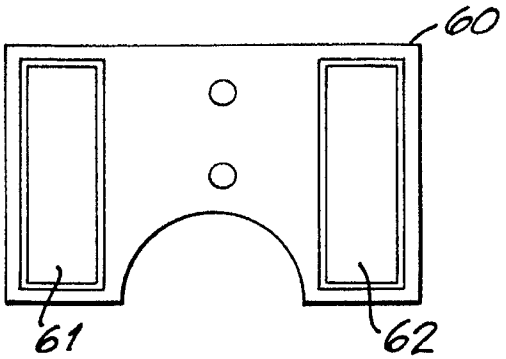
FIG. 23 is a plan view.
Figure 24:
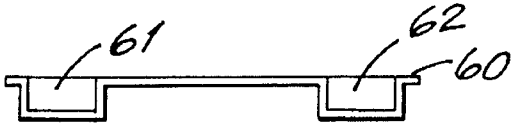
FIGS. 24 and 25 are cross sectional side views of a plastic strip suitable for mounting in the head of a golf club.
Figure 25:
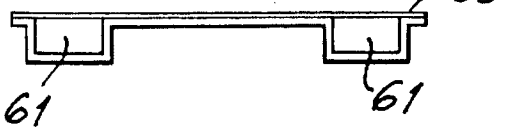

Referring now to FIGS. 23–25, a plastic strip 60 is shown having chambers 60 and 61. The mass particles will be mounted in the chambers. In the arrangement of FIG. 24, the chamber volume can accept 10 grams of lead having an inside dimension of 10×5×32 mm. The chamber strip has a thickness of 1 mm while the top cover is 0.5 mm and is ultrasonically welded to cover the chambers after the mass particles have been inserted therein.

Figure 26:
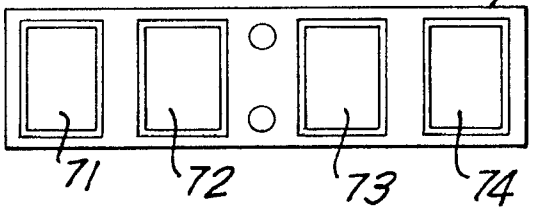
FIG. 26 is a plan view.
Figure 27:
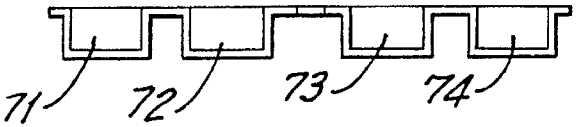
FIGS. 27 and 28 are cross sectional side views of a second embodiment of a plastic strip that can be used in the head of a golf club.
Figure 28:
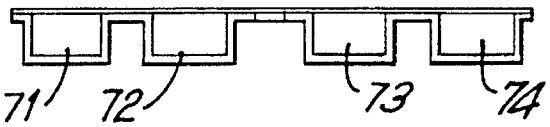

While the arrangement of FIGS. 23–25 have two chambers, the arrangement in FIGS. 26–28 shows a strip 70 having four chambers 71, 72, 73 and 74, respectively. In the arrangement of FIG. 27, the chamber volume is such that it will accept 5 grams of lead each while the inside dimensions are 10×6×15 mm. The thickness of the chambers strip in FIG. 27 is 1 mm, while the thickness of the chambers strip of FIG. 28 is 0.5 mm. Experiments have shown that the two chamber embodiment of FIGS. 23–25 are satisfactory for the better golf players, while the four chamber embodiment of FIGS. 26–28 are better for the untrained players. That is, having the additional particles spread out over the four chambers provides better ball control which is not generally required for the better players.

Figure 29:
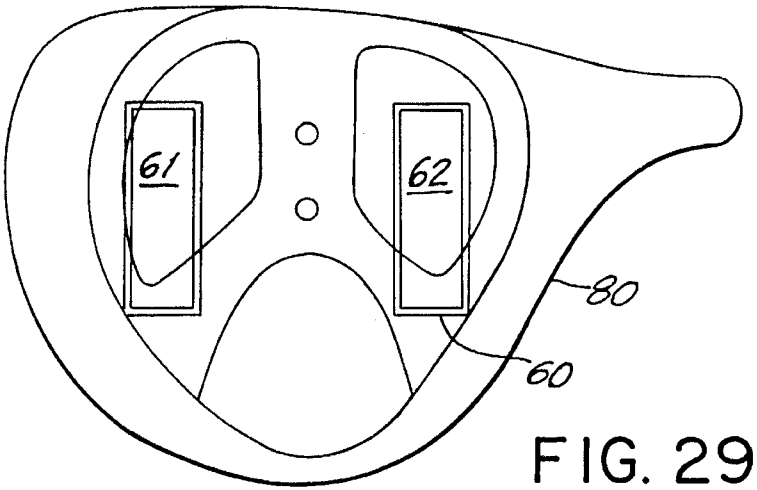
FIG. 29 is a plan view.
Figure 30:
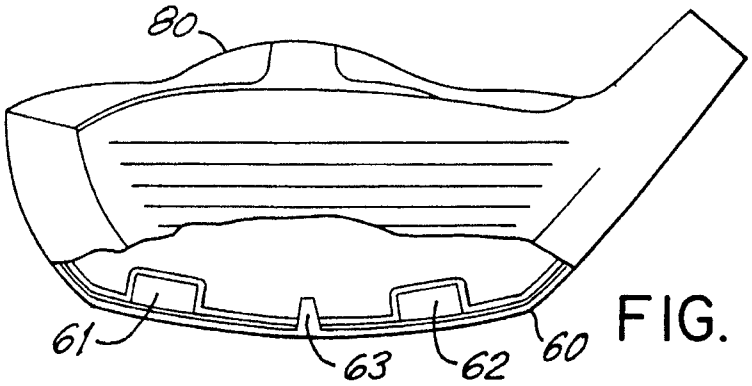
FIG. 30 is a side view of a head of a golf club with FIG. 30 being partially broken away to show the plastic strip of FIGS. 23–25 mounted therein.

In FIGS. 29 and 30, is shown a golf club head 80 having the plastic strip of FIGS. 23–25 installed therein. An adjustment pin 63 is provided at the bottom of the club head 80.

Figure 31:
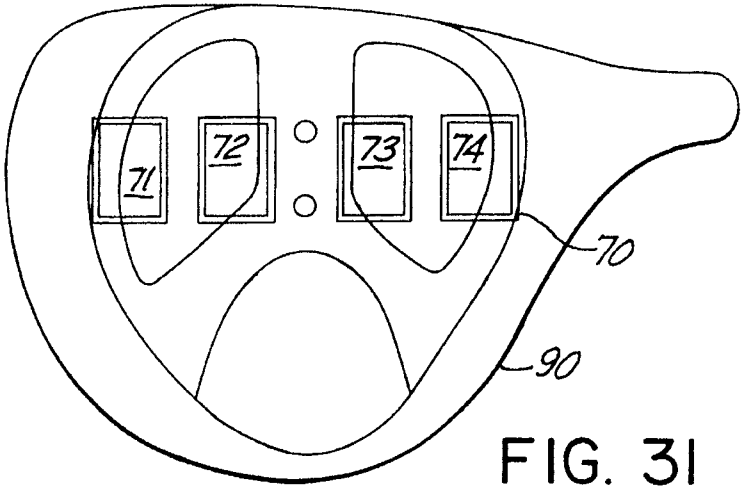
FIG. 31 is a plan view.
Figure 32:
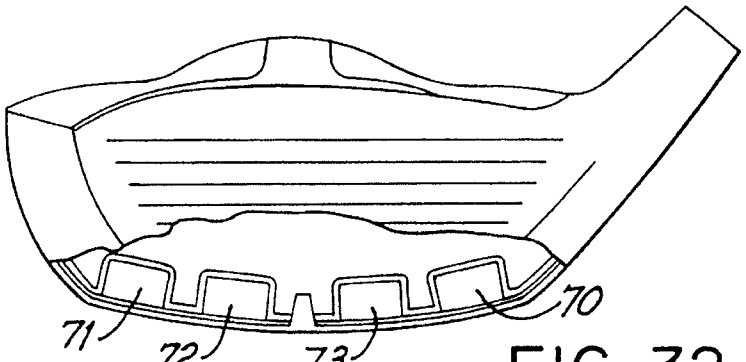
FIG. 32 is a side view partially broken away of the head of a golf club showing the plastic strip of FIGS. 26–28 mounted therein.

In FIGS. 31 and 32, is shown a golf club head 90 having the plastic strip of FIGS. 26–28 installed therein.

Figure 35:
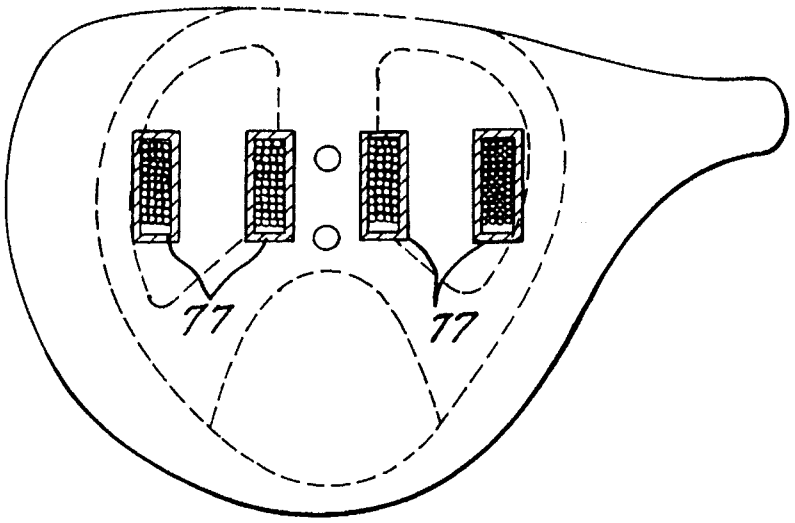
FIG. 35 is a plan view similar to FIG. 33 but showing the position of the movable pass particles after impact with the golf ball.
Figure 33:
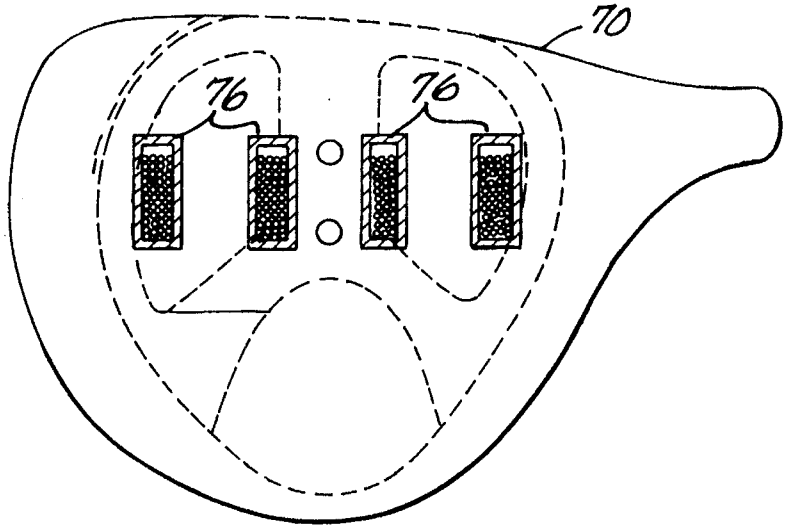
FIG. 33 is a plan view.
Figure 34:
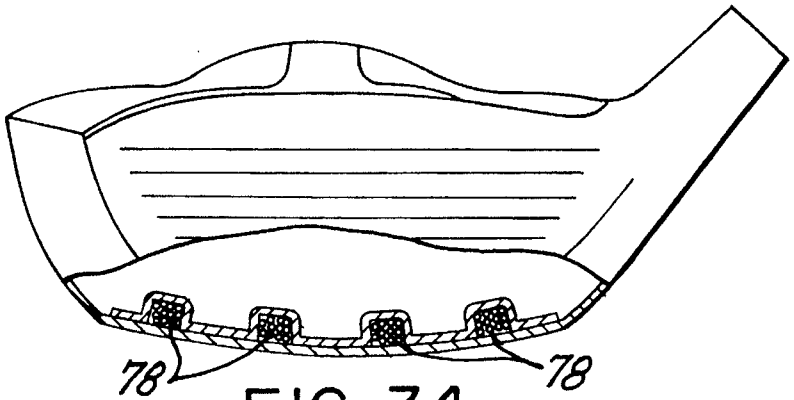
FIG. 34 is a side view partially broken away of a head of a golf club having the plastic strip of FIGS. 26–38 mounted therein with the movable mass particles arranged in the chambers.

The plastic strip or carrier belt can either be made of plastic or of deep-drawable metal foil. The chambers can be formed by deep-drawing the foil and closed at the filling with the movable masses in the form of lead shot by utilization of another foil which covers the chambers. The covering foil can be adhered to cover the chambers by means of adhesive, welding, hot melting or similar general systems used in the art depending on the material used. It can be seen that the carrier belt is positioned near the bottom of the club head and it can be fixed at its position by means of adhesive as an example. The chambers are shown in FIGS. 33–35 filled with the mass particles. In FIG. 33, the position of the mass particles is shown before impact with the ball. It can be seen that the particles are all near the back portion of the club 70 with a void 76 between the particles and the front portion of the chamber.

In FIG. 35, after impact with the ball the mass particles have been moved forward in the chamber so that the void 77 is now at the rear of the chambers. The club illustrated in FIGS. 29–35 is a left-handed club driver with the face impacted at the top of the Figure.

FIG. 34 shows the position of the mass particles 78 at the bottom of the club.

Figure 37:
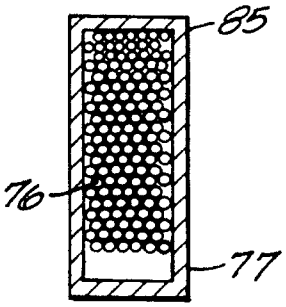
FIGS. 36 and 37 are cross sectional views of one of the kinetic mass chambers of the plastic strip showing the movable mass particles before and after impact, respectively.
Figure 36:
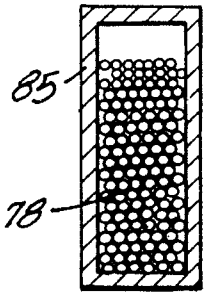

FIGS. 36 and 37 are enlarged views of the chambers of 85 having the mass particles 78 therein. The void 76 at the top of the chamber before impact is shown, whereas the void 77 at the bottom of the chamber is shown in FIG. 37. The direction of the stroke is shown going from the bottom of the Figure toward the top, FIG. 36 being before impact and FIG. 37 being after impact.

It is also within the concept of the present invention to install a similar strip in the grip of the golf club. It is not uncommon for the golf club to hit not only the ball but to also hit the ground beneath the ball. In such case, the movable masses in the chambers built in the head will show no great function and effect but an additional chamber with such movable mass particles built in the handle can diminish the recoil and impact forces. Thus, such chamber could be built into the handle portion of the golf club as well as into the head portion of the golf club.

It is clear from the above description that the utilization of the kinetic energy system incorporated into the principles of the present invention will greatly reduce the recoil impact and add greatly to the enjoyment of the game by the golf player. It also will substantially eliminate the hard impact and vibration that develops even when the ball is hit properly.

While the invention has been described in detail with respect to particular preferred examples and embodiments, it will be understood by those skilled in the art that various changes and modifications may be made without departing from the spirit and scope of the invention.

What is claimed is:

1. A golf club having a ball contact portion and a shaft including a handle portion, comprising at least one chamber filled with one of silicone foam and jelly-like plastic material and arranged in said ball contact portion; freely movable mass including a plurality of freely movable mass particles embedded in said one of foam an jelly-like plastic, the volume of said chamber being very small compared to the interior of said ball contact portion, said freely movable mass being able to move when said golf club is moved into contact with a ball, any vibration of said golf club resulting from said contact being dampened.

2. A golf club according to claim 1, wherein said ball contact portion includes a plurality of chambers arranged one next to the other along a longitudinal line of said golf club.

3. A golf club according to claim 1, further comprising at least one further chamber including a displaceable or compressible mass provided in the shaft.

4. A golf club according to claim 1, wherein said freely movable mass is a ball, the movement of said ball being attenuated by the one of silicone foam and jelly-like plastic material functioning as a viscous medium.

5. A golf club according to claim 1 wherein the movable mass particles are a metal granulate having a particle size in a range of 0.4 to 0.8 mm in diameter.

6. A golf club according to claim 5, wherein the metal granulate is lead shot.

7. A golf club comprising a head portion including a plurality of chambers, the volume of each said chamber being substantially smaller than the volume of the golf club head portion, a major portion of each said chamber being filled with unelastic mass particles and a smaller portion of each said chamber being void, the unelastic mass particles being displaced within the chamber during a swing of the golf club, said chambers being near a bottom of the head portion and being affixed to a strip.

8. A golf club according to claim 7, further comprising at least one additional mass chamber within a grip end of a shaft connected to said club head portion to eliminate shock impulses and vibrations of the shaft.

9. A golf club comprising a head portion including a plurality of chambers, the volume of each said chamber being substantially smaller than the volume of the golf club head portion, said chambers being within a carrier belt having a main plane located within the head and along a bottom surface of the head, a major portion of each chamber being filled with unelastic mass particles and a smaller portion of each said chamber being void, the unelastic mass particles being displaced within the chamber during a swing of the golf club, said chambers being near a bottom of the head portion.

10. A golf club according to claim 9, wherein a longest diameter of each said chamber is oriented along a direction of said swing of the golf club.

11. A golf club according to claim 9, wherein the carrier belt is adhesively connected to an interior bottom wall of the head.

12. A golf club according to claim 9, wherein said carrier belt is a thermoplastic deep drawable and weldable plastic foil wherein said chambers are deep-drawn and closed by welding or glueing with a second foil.

13. A golf club according to claim 9, wherein said carrier belt is a thermoplastic deep drawable and weldable plastic foil wherein said chambers are deep-drawn, and further comprising a top cover closing said chambers.

14. A golf club according to claim 13, wherein said top cover is ultrasonically welded to said chambers.

* * * * *